US010023993B2

(12) United States Patent
Thomas et al.

(10) Patent No.: US 10,023,993 B2
(45) Date of Patent: Jul. 17, 2018

(54) CUTTING GUIDE WITH SEAM ALLOWANCE RECESS

(71) Applicant: USAUS Holdings LLC, Loveland, CO (US)

(72) Inventors: Janna Lee Thomas, Loveland, CO (US); Paul Roger Thomas, Loveland, CO (US)

(73) Assignee: USAUS Holdings LLC, Loveland, CO (US)

( * ) Notice: Subject to any disclaimer, the term of this patent is extended or adjusted under 35 U.S.C. 154(b) by 91 days.

(21) Appl. No.: 15/342,037

(22) Filed: Nov. 2, 2016

(65) Prior Publication Data

US 2017/0051451 A1 Feb. 23, 2017

Related U.S. Application Data

(63) Continuation-in-part of application No. 15/280,747, filed on Sep. 29, 2016, which is a continuation of application No. 12/584,015, filed on Aug. 28, 2009, now Pat. No. 9,458,566.

(51) Int. Cl.

| | |
|---|---|
| ***D06H 7/06*** | (2006.01) |
| ***D06H 7/04*** | (2006.01) |
| ***B26B 29/06*** | (2006.01) |
| ***D06H 7/02*** | (2006.01) |
| *D06H 7/00* | (2006.01) |

(52) U.S. Cl.

CPC ..... *D06H 7/06* (2013.01); *B26B 29/06* (2013.01); *D06H 7/02* (2013.01); *D06H 7/04* (2013.01); *D06H 7/00* (2013.01); *Y10T 29/49828* (2015.01); *Y10T 83/04* (2015.04)

(58) Field of Classification Search

CPC .. D06H 7/02; D06H 7/04; D06H 7/06; D06H 7/10; Y10T 83/8822; Y10T 83/8821; A47J 47/005; B26B 29/06

See application file for complete search history.

(56) References Cited

U.S. PATENT DOCUMENTS

| | | | |
|---|---|---|---|
| 816,529 | A | 3/1906 | Burts |
| 2,494,301 | A | 1/1950 | Lowe |
| 3,292,477 | A | 12/1966 | Raftery |
| 3,726,165 | A | 4/1973 | Hendrickson |
| 3,805,720 | A | 4/1974 | Hunt |
| 3,911,584 | A | 10/1975 | Ajus et al. |
| 4,218,947 | A | 8/1980 | Laviola |
| 4,462,168 | A | 7/1984 | Lynch et al. |

(Continued)

FOREIGN PATENT DOCUMENTS

| | | |
|---|---|---|
| DE | 3525959 | 6/1986 |
| DE | 3525959 A * | 6/1986 |

(Continued)

OTHER PUBLICATIONS

English traslation of KR 2009059178 (which is the same as the attached document KR102009059178).*

(Continued)

*Primary Examiner* — Jennifer Swinney

(74) *Attorney, Agent, or Firm* — Craig R. Miles; CR Miles P.C.

(57) ABSTRACT

A cutting guide having a seam allowance recess and methods of cutting a piece of material with such cutting guide.

28 Claims, 9 Drawing Sheets

(56) References Cited

U.S. PATENT DOCUMENTS

| | | | | |
|---|---|---|---|---|
| 4,524,522 | A | 6/1985 | Perry | |
| 4,646,666 | A | 3/1987 | Burrier | |
| 4,741,235 | A * | 5/1988 | Price | B29C 65/00 83/452 |
| 4,779,346 | A | 10/1988 | Schafer | |
| 4,930,382 | A | 6/1990 | Collins | |
| 5,138,759 | A | 8/1992 | Gruetzmacher | |
| 5,191,716 | A | 3/1993 | Anderson | |
| 5,347,724 | A | 9/1994 | Hankins | |
| 5,365,822 | A | 11/1994 | Stapleton et al. | |
| 5,557,996 | A | 9/1996 | Reber et al. | |
| 5,579,670 | A | 12/1996 | McCormick | |
| 5,638,605 | A | 6/1997 | Sligar | |
| 5,749,149 | A | 5/1998 | Claytor | |
| 5,823,086 | A | 10/1998 | McCormick | |
| 5,829,150 | A | 11/1998 | McEligot | |
| 6,158,135 | A | 12/2000 | Rank | |
| 6,276,070 | B1 | 8/2001 | Hawley | |
| 6,321,458 | B1 | 11/2001 | Hess | |
| 6,434,844 | B1 | 8/2002 | Rank | |
| 6,696,129 | B1 | 2/2004 | Cotton | |
| 6,799,379 | B2 | 10/2004 | Brady | |
| 6,839,971 | B2 | 1/2005 | Schafer et al. | |
| 6,854,189 | B2 | 2/2005 | Schafer | |
| 6,925,724 | B2 | 8/2005 | Tandy | |
| 6,944,963 | B2 | 9/2005 | Amaru | |
| 7,028,412 | B2 | 4/2006 | Boomershine | |
| 7,032,319 | B2 | 4/2006 | Ollgaard et al. | |
| 7,043,850 | B2 | 5/2006 | Brady | |
| 7,100,295 | B1 | 9/2006 | Chang | |
| 7,134,399 | B1 | 11/2006 | Gulsby | |
| 7,185,441 | B2 | 3/2007 | Lockyer | |
| 7,383,640 | B2 | 6/2008 | Barry | |
| D577,617 | S | 9/2008 | Tucker | |
| 7,536,803 | B2 | 5/2009 | Samuels | |
| 7,568,295 | B1 | 8/2009 | Strain | |
| D601,442 | S | 10/2009 | Haren | |
| 2003/0159556 | A1 * | 8/2003 | Cleveland | D06H 7/04 83/13 |
| 2004/0049935 | A1 | 3/2004 | Tandy | |
| 2006/0130344 | A1 | 6/2006 | Schafer | |
| 2007/0042128 | A1 | 2/2007 | Waterfield | |
| 2007/0220769 | A1 | 9/2007 | Oehlke et al. | |
| 2011/0047804 | A1 | 3/2011 | Thomas et al. | |
| 2016/0067873 | A1 | 3/2016 | Dickinson et al. | |

FOREIGN PATENT DOCUMENTS

| | | | | |
|---|---|---|---|---|
| DE | 202010016333 U1 * | 2/2011 | | A47J 47/005 |
| EP | 1322809 B1 | 12/2005 | | |
| EP | 1613804 B1 | 11/2008 | | |
| FR | 2720309 | 12/1995 | | |
| KR | 2009059178 | * 6/2009 | | |
| WO | WO 97/28932 | 8/1997 | | |
| WO | WO 2002/029147 | 4/2002 | | |
| WO | WO 2004/092473 | 10/2004 | | |

OTHER PUBLICATIONS

PCT International Patent Application No. PCT/US17/59207; International Search Report and Written Opinion of the International Searching Authority dated Jan. 5, 2018, 9 pages.

AudreysSewingBasket.com. Website, http://audreysewingbasket.com, originally downloaded Feb. 11, 2010, 3 pages total.

Create for Less. On-line catalog, http://www.createforless.com, originally downloaded Jan. 26, 2010, 20 pages total.

Hancock'S of Paducah. Item List—Rulers. On-line catalog, http://www.hancocks-paducah.com, originally downloaded Apr. 20, 2010, 3 pages total.

Quality Sewing & Vacuum Top Tools: Audrey's "No Wobble Ruler". Quality Sewing Blog, http://shopqualitysewing.com, originally downloaded Feb. 11, 2010, 2 pages total.

Quilting Tools & Accessories. Rotary Cutting Grids & Rulers. On-line catalog, http://www.ericas.com, originally downloaded Jan. 26, 2010, 14 pages total.

Quilt Patterns. Quilt Cutting Guides and Tools. Website, http://www.quiltpatterns.org, originally downloaded Apr. 20, 2010, 3 pages total.

Save on Crafts. Quilting Rulers & Grids. On-line catalog, http://www.save-on-crafts.com, Apr. 20, 2010, 2 pages total.

Westalee Design, Adjustable Rulers. On-line catalog, http://www.westalee.com.au, originally downloaded Apr. 20, 2010, 8 pages total.

Whelan, S. Adjustable Rulers for Accurate Cutting of Quilt and Patchwork Pieces. Review: Quilting Ruler with Locking Fabric Guide; http:/quilting.suite101.com, originally downloaded Aug. 6, 2008, 5 pages total.

U.S. Appl. No. 15/280,747, filed Sep. 29, 2016.

Crooked Creek Quilt Shop. No Rock Ruler. Website, http://www.crookedcreekquiltshop.com, originally downloaded Sep. 28, 2016, 2 pages total.

* cited by examiner

CUTTING GUIDE WITH SEAM ALLOWANCE RECESS

This United States Patent Application is a continuation-in-part of U.S. patent application Ser. No. 15/280,747, filed Sep. 29, 2016, which is a continuation of U.S. patent application Ser. No. 12/584,015, filed Aug. 28, 2009, now U.S. Pat. No. 9,458,566, issued Oct. 4, 2016, each hereby incorporated by reference herein.

I. FIELD OF THE INVENTION

Generally, a cutting guide having a seam allowance recess which can be used with a cutting tool to cut a piece of material.

II. BACKGROUND OF THE INVENTION

Conventional cutting guides measure material typically having a square or rectangular shape and are of a thickness sufficient to guide a cutting tool along one side to cut material extending beyond the periphery of the cutting guide in order to cut the material. The cutting guide may also provide on one or both surfaces a set of visible marks spaced at intervals useful for measurement or placement of the cutting guide on the piece of material to be cut. An example of a conventional cutting guides is described in U.S. Pat. No. 6,925,724.

A substantial problem with conventional cutting guides can be that the surface(s) which engage the piece of material to be cut are substantially flat while the piece of material to be cut may include a seam along with a seam allowance which results in a raised portion in the material to be cut. Placing a conventional cutting guide on a seam, a seam allowance, or other raised area, point or support in the piece of material to be cut can cause a conventional cutting guide to wobble, pivot, or otherwise move in relation to the raised area in the piece of material.

Movement of the cutting guide in relation to a raised area in the piece of material to be cut results in corresponding movement of the side of the cutting guide along which the cutting tool engages to cut the piece of material. If the cutting guide shifts in position as the cutting tool cuts the piece of material a unintended irregularity can be created in the edge of the cut material. Additionally, movement of the cutting guide can result in disengagement of the cutting tool with the cutting guide. The cutting tool may then be free to travel across the material in an unintended direction or cut the hand of the cutting tool user.

Another substantial problem with conventional cutting guides can be that, there is no means other than visible marks on the cutting guide to assist in determining placement of the cutting guide on the piece of material to be cut. Typically, the placement of a conventional cutting guide on a piece of material to be cut is determined by matching visible marks on the cutting guide (or the corners of the cutting guide) with a stitching line or seam in the material to be cut. Additionally, once the placement of the cutting guide on the piece of material to be cut is determined there may be no cutting guide element to fix the placement of the cutting guide in relation to piece of material to be cut. As a result, determination of the location at which to place the conventional cutting guide may be uncertain and the cutting guide may move from the location before cutting of the piece of material is complete.

The inventive cutting guide with a seam allowance recess and inventive methods of using the inventive cutting guide with a seam allowance recess addresses each of the foregoing problems associated with conventional cutting guides and conventional methods of using a cutting guide.

II. SUMMARY OF THE INVENTION

Accordingly, a broad object of the invention can be to provide a cutting guide having a recess of sufficient dimension to receive a seam, a seam allowance, or other raised portion of a piece of material to be cut. The raised portion of the piece of material being received within the recess of the cutting guide reduces or eliminates any point or support on which the cutting guide can pivot or wobble and allows the cutting guide to engage the piece of material to be cut outside of a raised portion with greater uniformity.

A second broad object of the invention can be to provide a recess in a cutting guide of sufficient dimension to receive a seam allowance. The recess can further provide a pair of opposed sides one of which be located to abut the seam allowance to fix the location of the cutting guide in relation to the piece of material to be cut.

Naturally, further objects of the invention are disclosed throughout other areas of the specification, drawings, photographs, and claims.

III. A BRIEF DESCRIPTION OF THE DRAWINGS

IV. DETAILED DESCRIPTION OF THE PREFERRED EMBODIMENTS

A cutting guide (6) having a recess (13) to receive a seam allowance (2) and methods of cutting a piece of material (1) with such cutting guide (6).

Figure 1:
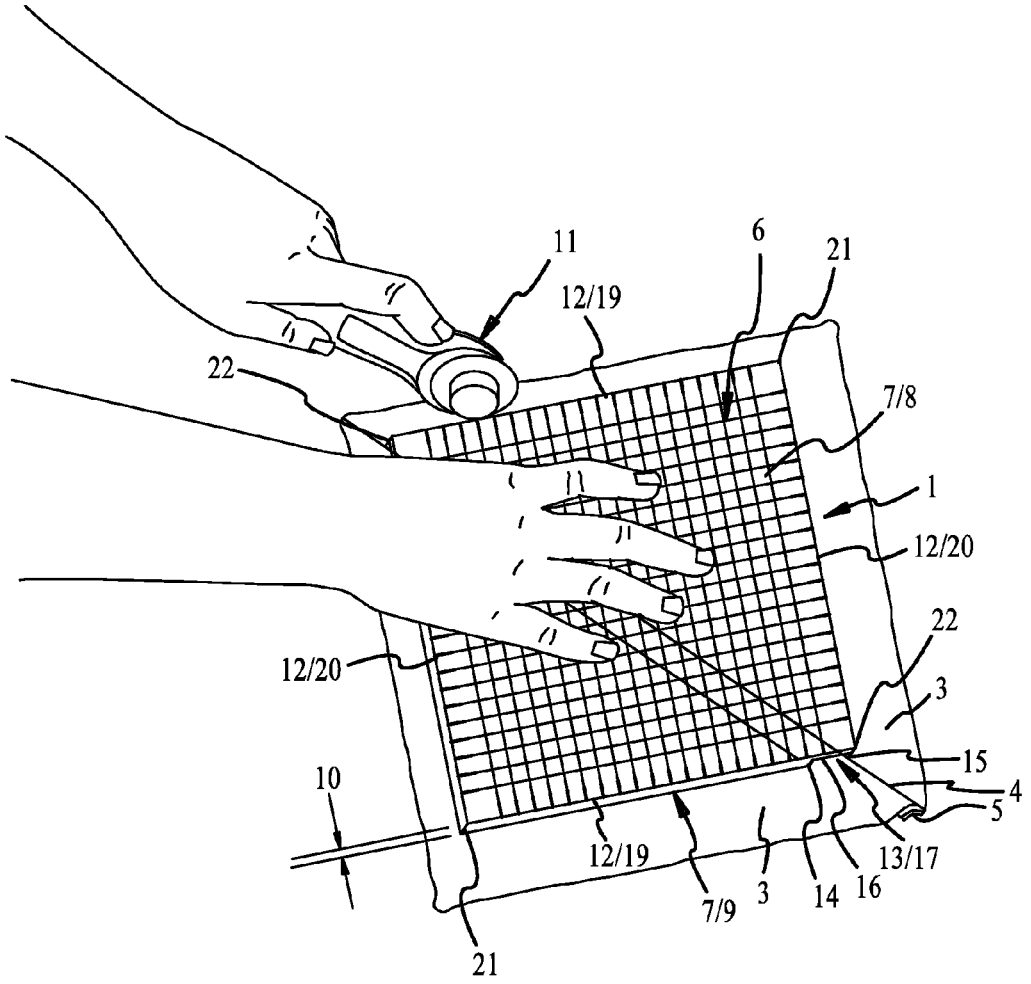
FIG. 1 shows a particular method of cutting a piece of material using an embodiment of a cutting guide having a recess of sufficient dimension to receive a seam allowance of a piece of material.
Figure 2:
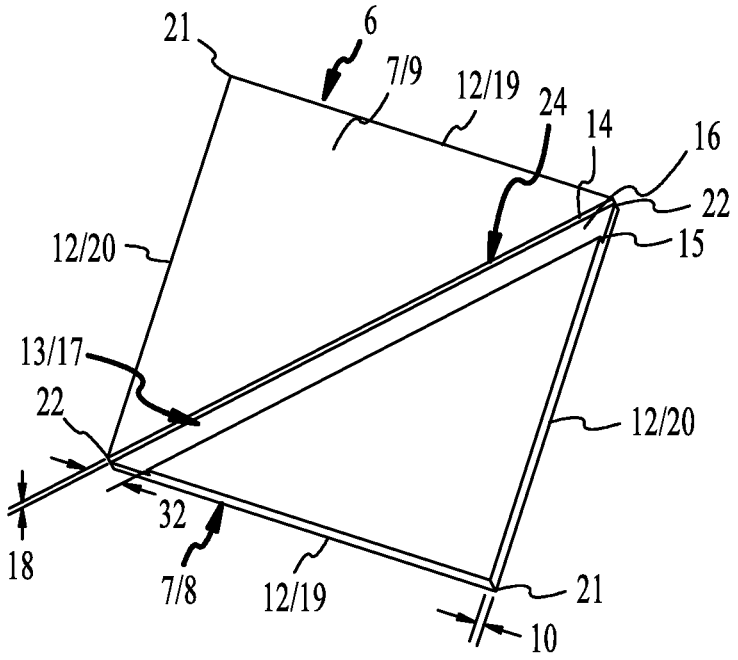
FIG. 2 is perspective view of a particular embodiment of the inventive cutting guide having a recess as shown in FIG. 1.
Figure 3:
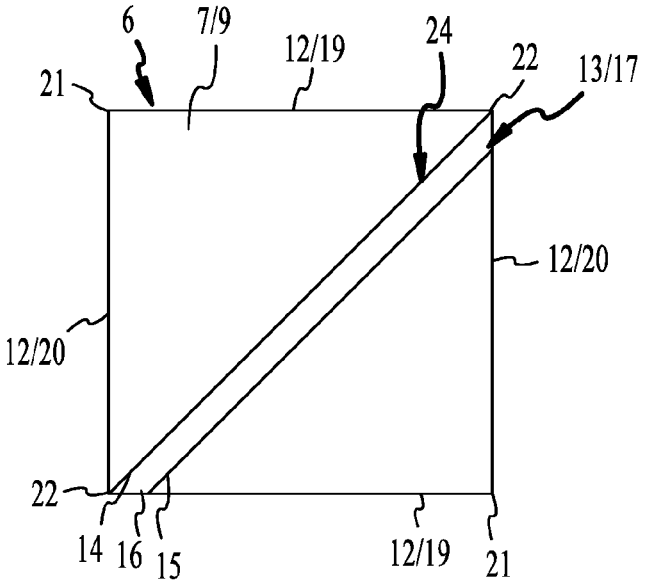
FIG. 3 is bottom plan view of a particular embodiment of the inventive cutting guide having a recess.
Figure 4:
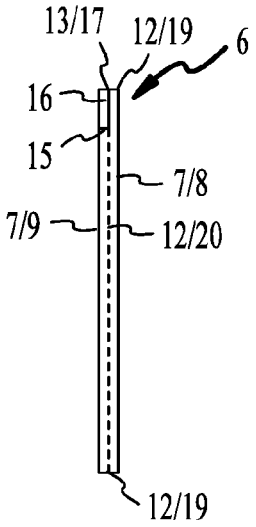
FIG. 4 is a side view of the particular embodiment of the inventive cutting guide having a recess shown in FIG. 3.
Figure 5:
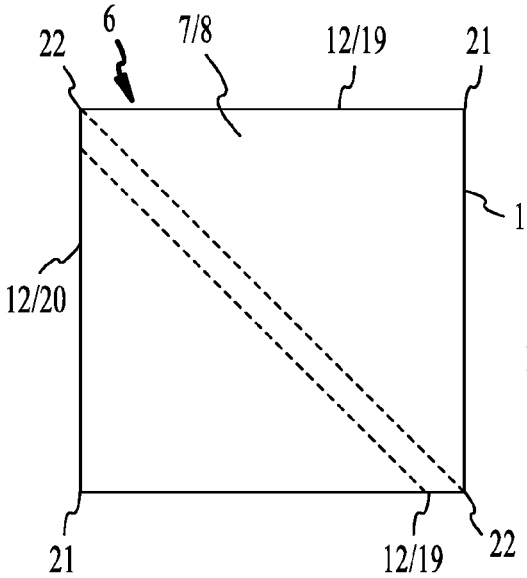
FIG. 5 is a top plan view of the particular embodiment of the inventive cutting guide having a recess shown in FIG. 3.
Figure 6:
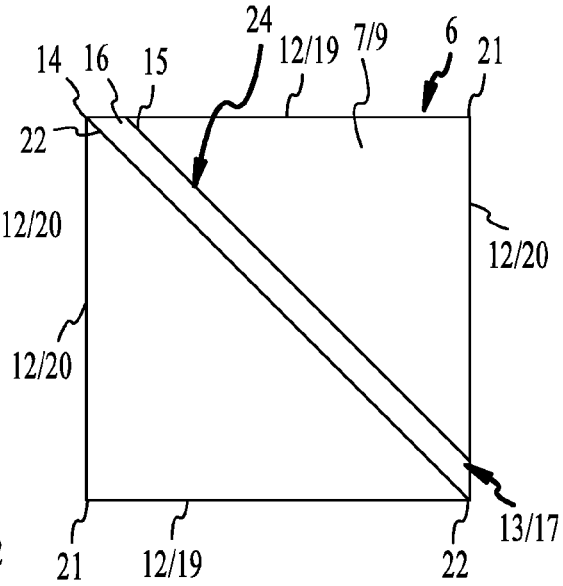
FIG. 6 is a bottom plan view of another particular embodiment of the inventive cutting guide having a recess.

Now referring primarily to FIG. 1, a particular method of cutting a piece of material (1) is illustrated. In a first step, the inventive method includes providing a piece of material (1) having a seam allowance (2) at which a pair of materials (3) join at a seam (4). The pair of materials (3) for the purposes of this invention means any manner of materials which can be joined by stitching or sewing (or other method such as application of heat or pressure) usually near the edge of the materials, such as woven fabric, whether of natural or synthetic fibers, leather, cloth, plastic, or the like. The area between the edge of the pair of materials (3) (or plurality of materials) and the stitching line or seam (4) is referred to herein as the seam allowance (2). The seam allowance (2) can range from about one-quarter inch wide (about 6.35 mm) to as much as several inches wide. Typically, however, the seam allowance (2) will have a range of about one-quarter inch and about five eighths inch. For the purposes of this invention the term "seam allowance (2)" also includes the flaps of material (5) between the edge of the pair of materials (3) (or plurality of materials) and the seam (4) (or stitching line) at which the pair of materials (3) (or plurality of materials) join. In another step of the inventive method, the flaps of material (5) can be folded or located on one side of the seam (4) at which the pair of materials (3) (or plurality of materials) join.

Again referring primarily to FIG. 1, the particular method of cutting a piece of material (1) can further include the step of providing a cutting guide (6). The cutting guide (6) can include (as further described below) a body (7) with a top surface (8) disposed in substantially parallel opposed relation to a bottom surface (9) having a thickness (10) sufficient to guide a cutting tool (11) along one of a plurality of sides (12) of the body (7). In particular embodiments, the bottom surface (9) can, but need not necessarily, be generally flat. A recess (13) having a pair of opposed sides (14)(15) and a cross member (16) can be disposed in the bottom surface (9) (or top surface (8)) of the body (7) of the cutting guide (6). The recess (13) can define a passage (17) which communicates with at least one of the plurality of sides (12) of the body (7) of the cutting guide (6). The recess (13) can have dimensions sufficient to receive the seam allowance (2) of the pair of materials (3) (or plurality of materials) joined at the stitching line or seam (4), and as to certain embodiments the recess (13) can receive the seam allowance (2) with the flaps of the material (5) located or folded to one side of the seam (4).

Again referring primarily to FIG. 1, the particular method of cutting a piece of material (1) can further include the step of engaging the bottom surface (9) (or the top surface (8), depending on which surface (8)(9) the recess (13) is disposed in) of the cutting guide (6) with the piece of material (1), so that the seam allowance (2) can be received within the recess (13) disposed in the cutting guide (6). By receiving the seam allowance (2) in the recess (13), the bottom surface (9) (or the top surface (8)) of the cutting guide (6) can engage the piece of material (1) on either side of the seam allowance (2). Particular embodiments of the method can further include the step of abutting one of the pair of opposed sides (14)(15) of the recess (13) against the seam (4) of the piece of material (1).

Again referring primarily to FIG. 1, the particular method of cutting a piece of material (1) can further include the step of guiding a cutting tool (11) along one or more of the plurality of sides (12) of the cutting guide (6) engaged with the piece of material (1) to receive the seam allowance (2) in the recess (13). In a further step, the piece of material (1) extending beyond one or more of the plurality of sides (12) can be cut with the cutting tool (11) guided along one of the plurality of sides (12) of the cutting guide (6).

Referring to FIGS. 2 through 24, particular embodiments of an inventive cutting guide (6) are shown. The cutting guide (6) can include a body (7) having a top surface (8) disposed in substantially parallel opposed relation to a bottom surface (9) having a thickness (10) sufficient to guide a cutting tool (11) along one of a plurality of sides (12) of the body (7) (as shown in FIG. 1 as an example). The cutting guide (6) can further include a recess (13) having a pair of opposed sides (14)(15) with a cross member (16) coupled between the opposed sides (14)(15) and disposed in the bottom surface (9) of said body (7), the recess (13) defining a passage (17) which communicates with at least one of the plurality of sides (12) of said body (7), the recess (13) having dimensions sufficient to receive a seam allowance (2) of a pair of materials (3) joined at a seam (4) with the bottom surface (9) engaged with the pair of materials (3) on either side of the seam allowance (2) (see FIG. 1).

As to particular embodiments of the cutting guide (6) shown in FIGS. 2-24, the body (7) can have a plurality of sides (12) disposed in a generally quadrilateral configuration (33), such as a substantially square or rectangular configuration (as shown in the examples of FIGS. 2-18), or a quadrilateral configuration (33) where none of the plurality of sides (12) of the quadrilateral configuration (33) are equal in length (as shown in the examples of FIGS. 19-24). The quadrilateral configuration (33) can have a configuration in which no interior angle (34) exceeds a measurement of about 180°, or in which at least one interior angle (34) exceeds a measurement of about 180°. The quadrilateral configuration (33) can have all generally unequal interior angles (34) with at least one interior angle (34) measuring about 90°, at least two interior angles (34) measuring about 90°, or all four interior angles (34) measuring about 90°.

The body (7) can be generated from a wide and numerous variety of materials such as metal, plastic, wood, or the like. The recess (13) disposed in the bottom surface (9) or the top surface (8) of the cutting guide (6) can, as non-limiting examples, be generated by molding the cutting guide (6) with the recess (13) as one piece in a mold, fabricating the cutting guide (6) in two or more layers which can be assembled to provide the recess (13), or cutting the recess (13) into the body (7) by removing material from the body (7). The thickness (10) of the body (7) sufficient to guide a cutting tool (11) while typically in the range of about one eighth inch to about five eighths inch is not so limited, and depending upon the application, the body (7) can have a greater or lesser thickness (10). Similarly, while the opposing sides (14)(15) of the recess (13) will typically be located in opposed relation a distance apart (32) in the range of about one-quarter inch and about three quarters inch, the invention is not so limited, and depending upon the application the opposing sides (14)(15) of the recess can be a greater or lesser distance (32) apart. The opposed sides (14)(15) will typically connect with the bottom surface (9) (or the top surface (8)) of the body (7) in substantially perpendicular relation and further connect with the cross member (16) in substantially perpendicular relation to provide a recess (13) of open square or rectangular configuration. The depth (18) of the recess (13) will typically be in a range of about one sixteenth inch and about five sixteenths inch; however, the invention is not so limited, and the dimensional relations of the recess (13) can be adjusted such that the seam allowance (2) (typically comprising the thickness of the two flaps of material (5) folded to one side of the seam (4) and the thickness of the joined material (3)) can be received within the recess (13) coincident with engagement of the bottom surface (9) (or the top surface (8)) with the surface of the joined pair of materials (3). Locating the seam allowance (2) within the recess (13) allows one of the surfaces (8)(9) of the cutting guide (6) to engage the joined pair of materials (3) without the seam allowance (2) acting as a point or support on which the cutting guide (6) pivots, wobbles or otherwise prevents fixed engagement of the cutting guide (6) with the joined pair of materials (3) (see also FIG. 1).

Figure 19:
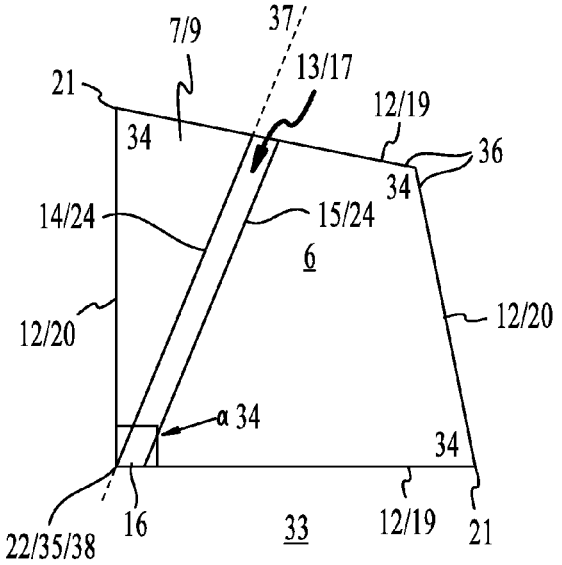
FIG. 19 is a bottom plan view of another particular embodiment of the inventive cutting guide having a recess.
Figure 20:
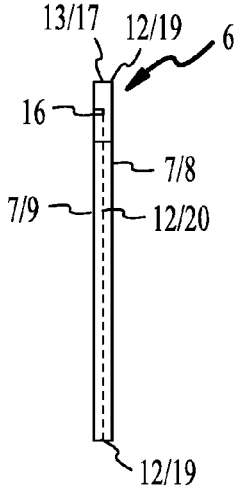
FIG. 20 is a side view of the particular embodiment of the inventive cutting guide having a plurality of recesses as shown in FIG. 19.
Figure 21:
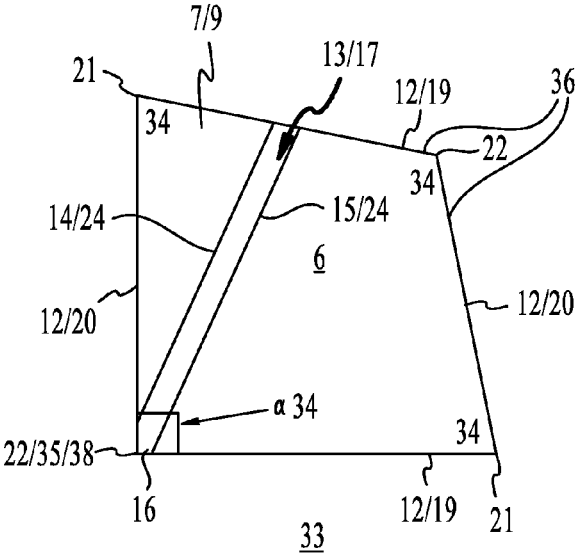
FIG. 21 is a bottom plan view of another particular embodiment of the inventive cutting guide having a recess.
Figure 22:
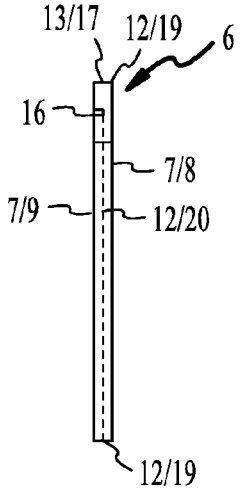
FIG. 22 is a side view of the particular embodiment of the inventive cutting guide having a plurality of recesses as shown in FIG. 21.
Figure 23:
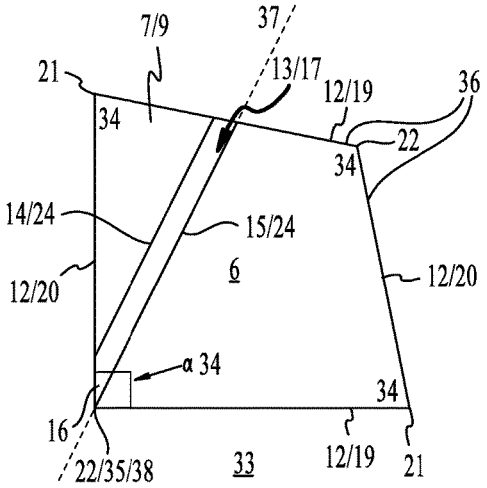
FIG. 23 is a bottom plan view of another particular embodiment of the inventive cutting guide having a recess.
Figure 24:
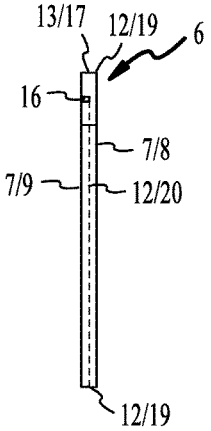
FIG. 24 is a side view of the particular embodiment of the inventive cutting guide having a plurality of recesses as shown in FIG. 23.

Referring primarily to FIGS. 19-24, particular embodiments of the cutting guide (6) having a quadrilateral configuration (33) where the plurality of sides (12) of the quadrilateral configuration (33) are not equal in length can have a recess (13) disposed in the body (7) of the cutting guide (6), so that the recess (13) intersects a corner (35) and one of the plurality of sides (12). In further particular embodiments, one of the pair of opposed sides (14)(15) of the recess (13) can be disposed in the body (7) to intersect one corner (35) of the quadrilateral configuration (33) and at least one of the non-consecutive sides (36) of the quadrilateral configuration (33). For the purposes used herein, the term "non-consecutive sides (36) of the quadrilateral configuration (33)" means sides (12) which do not comprise the sides of the quadrilateral configuration which intersect to form the corner (35) intersected by the recess (13) or one of the opposed sides (14)(15) of the recess (13). By way of example, one of the interior angles (34) of the quadrilateral configuration (33) can, but need not necessarily, have a measurement of about 90 degrees. The recess (13) can be disposed in the quadrilateral configuration (33) in at least three illustrative configurations. In the first configuration, the recess (13) can be located so that the recess (13) intersects the corner (35) having an interior angle (34) of about 90 degrees and one of the non-consecutive sides (36) of the interior angle (34) (FIG. 21). In the other two configurations, one of the linear opposed sides (14)(15) of the recess (13) can be located on an axis (37) which intersects the corner (35) at the vertex (38) of the interior angle (34) of about 90 degrees and one of the non-consecutive sides (36) (FIGS. 19 and 22).

Figure 7:
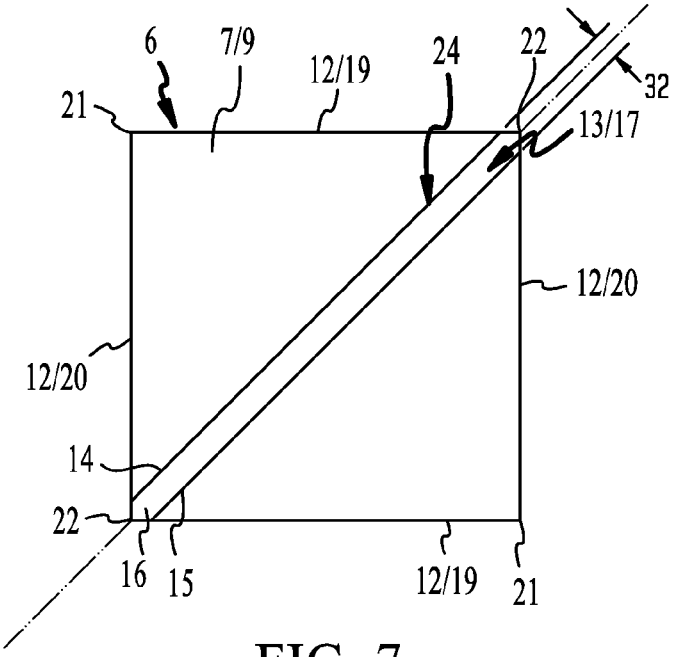
FIG. 7 is a bottom plan view of another particular embodiment of the inventive cutting guide having a recess.
Figure 8:
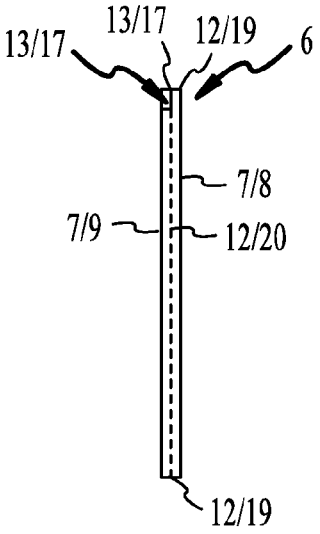
FIG. 8 is a side view of the particular embodiment of the inventive cutting guide having a recess shown in FIG. 7.

Again referring primarily to FIGS. 2-8, particular embodiments of the cutting guide (6) shown further includes a recess (13) which defines a passage (17) which communicates between at least two of the plurality of sides (12) of the body (7). By way of example, where the body (7) has a substantially rectangular configuration with two pairs of opposed sides (19)(20) and a corresponding two pairs of diagonally opposed corners (21)(22) the recess (13) can define a passage (17) which communicates between one of the two pairs of diagonally opposed corners (21)(22) of the body (7). Referring specifically to FIGS. 7 and 8, as to particular embodiments, the pair of opposed sides (14)(15) of the recess (13) can be located a distance from the diagonal axis (23) which runs between diagonally opposed corners (21) (broken line shown in FIG. 7 as an example). Now referring specifically to FIGS. 2-5, as to other embodiments of the invention, one of the opposed sides (14) of the recess (13) can intersect with both of the diagonally opposed corners (21). The placement of the recess (13), as described, which can define a passage which communications between one of the two pairs of diagonally opposed corners (21)(22) of the body (7), can also be achieved when the cutting guide has a quadrilateral configuration, as detailed above, where the cutting guide is not substantially configured as a square or rectangle.

Figure 9:
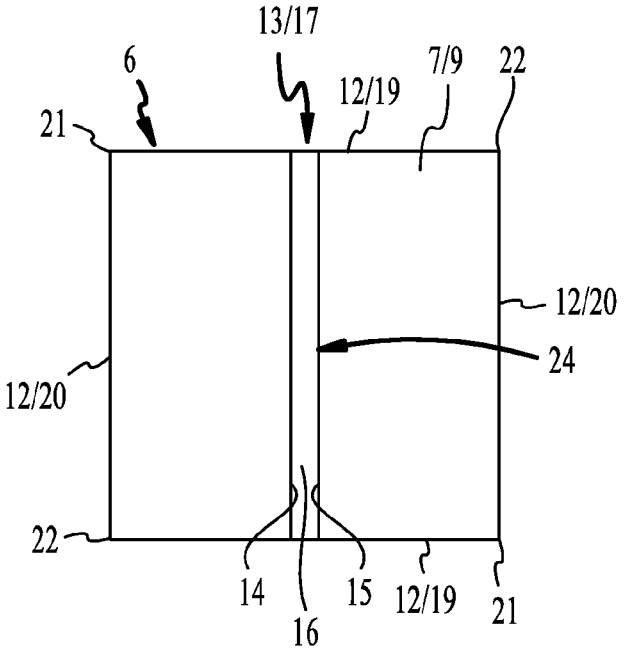
FIG. 9 is a bottom plan view of another particular embodiment of the inventive cutting guide having a recess.
Figure 10:
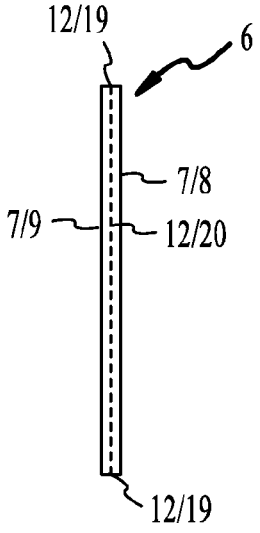
FIG. 10 is a side view of the particular embodiment of the inventive cutting guide shown in FIG. 9.

Now referring primarily to FIGS. 9 and 10, which shows a particular embodiment of the cutting guide (6) which provides a body (7) having a substantially rectangular configuration with two pairs of opposed sides (19)(20) in which the recess (13) disposed in the bottom surface (9) defines a passage (17) which communicates between one of the two pairs of opposed sides (19) of said body (7). The placement of the recess (13), as described, which can define a passage which communications between one of the two pairs of diagonally opposed corners (21)(22) of the body (7), can also be achieved when the cutting guide has a quadrilateral configuration, as detailed above, where the cutting guide is not substantially configured as a square or rectangle.

Figure 11:
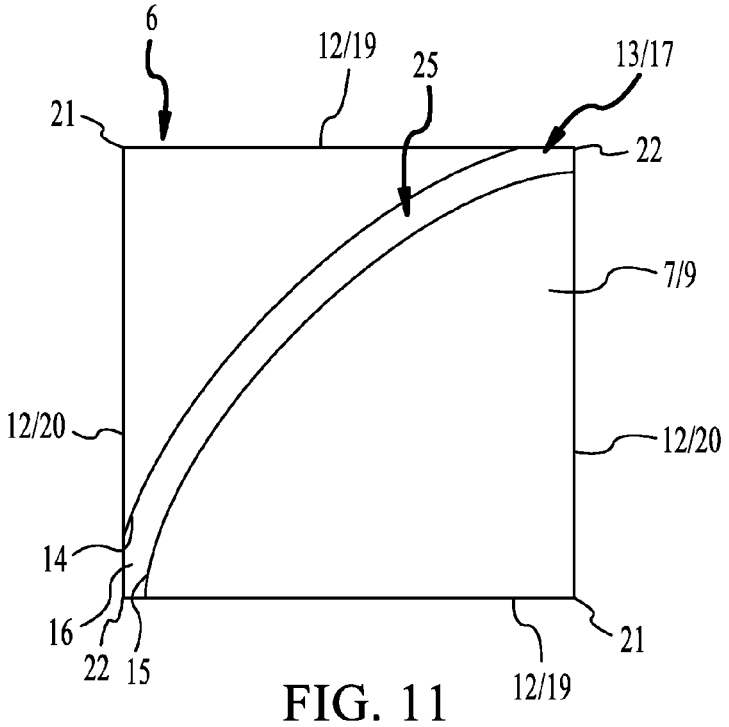
FIG. 11 is a bottom plan view of another particular embodiment of the inventive cutting guide having a recess having an amount of curvature.
Figure 12:
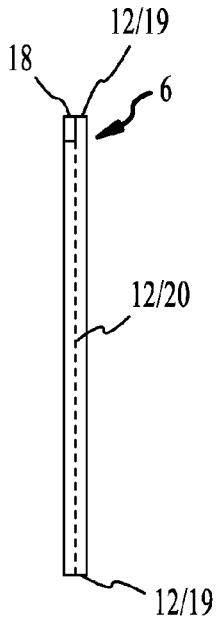
FIG. 12 is a side view of the particular embodiment of the inventive cutting guide having a recess shown in FIG. 11.
Figure 13:
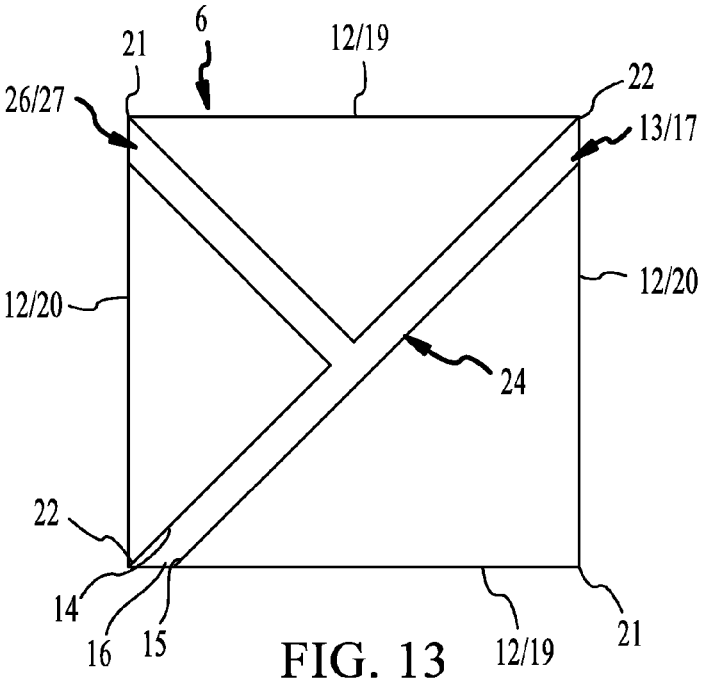
FIG. 13 is a bottom view of another particular embodiment of the inventive cutting guide having a first recess and a second recess.
Figure 14:
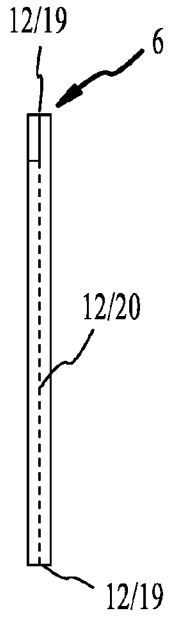
FIG. 14 is a side view of the particular embodiment of the inventive cutting guide having a first recess and a second recess shown in FIG. 13.

Each of the embodiments of the invention shown in FIGS. 1-8 provide a recess (13) having substantially linear parallel opposed sides (24); however, the invention is not so limited and as shown for example in FIGS. 11-12 the recess (13) as to certain embodiments can provide opposed sides (14)(15) having an amount of curvature (25). The curvature of the recess (13), as described, can also be achieved when the cutting guide has a quadrilateral configuration, as detailed above, where the cutting guide is not substantially configured as a square or rectangle.

Now referring primarily to FIGS. 13-18, certain embodiments of the invention can further include a second recess (26) having a pair of opposed sides (14)(15) and a cross member (16) disposed in the bottom surface (9) of the body (7) (or the top surface (8)). The second recess (26) can have dimensions sufficient to receive the seam allowance (2) of a pair of materials (3) joined at a seam (4) with said bottom surface (9) engaged with said pair of materials (3) on either side of said seam allowance (2). As to the embodiment shown in FIGS. 13-14, the second recess (26) defines a second passage (27) which can communicate between said first recess (13) and at least one of said plurality of sides (12) of the body (7). Extending the second recess (26) would result in an embodiment which defines a second passage (27) which communicates with the first recess (13) and two of the plurality of sides (12) of the body (7). Certain embodiments can provide the body (7) having a substantially rectangular configuration with two pairs of opposed sides (19)(20) and a corresponding two pairs of diagonally opposed corners (21)(22) in which the second recess (26) defines a passage which communicates between one of the two pairs of opposed sides (19) and the first recess (13) communicates between the second of the two pairs of opposed sides (20) (not shown). Again, certain embodiments can provide a second recess (26) which defines a passage (27) which communicates between one of said two pairs of diagonally opposed corners (21)(22). One of said opposed sides (14) of the second recess (26) which communicates between one of said two pairs of diagonally opposed corners (21) of the body can intersect both of said diagonally opposed corners (21). The first and second recesses (13)(27), as described, can also be achieved when the cutting guide has a quadrilateral configuration, as detailed above, where the cutting guide is not substantially configured as a square or rectangle.

Figure 15:
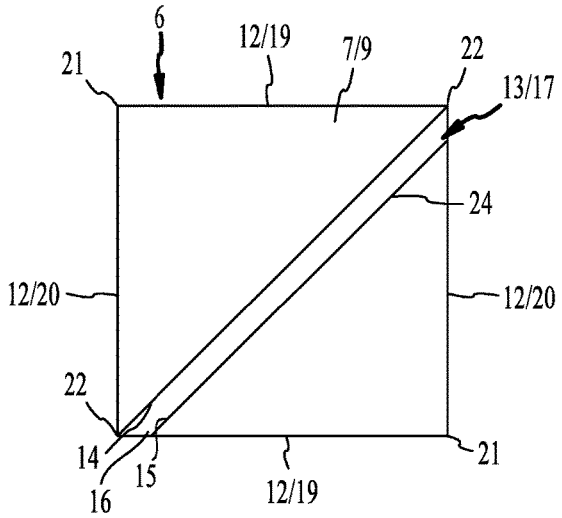
FIG. 15 is bottom plan view of another particular embodiment of the inventive cutting guide having a first recess disposed in the bottom surface of the body of the cutting guide and a second recess disposed in the top surface of the body of the cutting guide.
Figure 16:
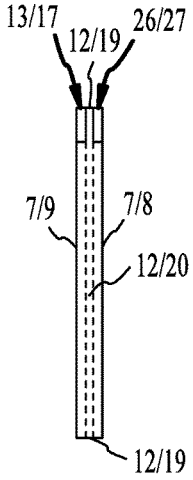
FIG. 16 is a side view of the particular embodiment of the inventive cutting guide having a first recess and a second recess as shown in FIG. 15.

Now referring primarily to FIGS. 15 and 16, certain embodiments of the invention can provide a first recess (13) and a second recess (27) disposed on opposed sides of the body (7) of the cutting guide (6). Each of the first recess (13) and the second recess (27) can have a pair of opposed sides (14)(15) and a cross member (16) defining a first passage (17) and a second passage (27) each of which communicates with at least one of said plurality of sides (12) of said body (7) with each recess (13)(27) having dimensions sufficient to receive a seam allowance (2) of a pair of materials (3) joined at a seam (4) with the corresponding top surface (8) or bottom surface (9) engaged with said pair of materials (3) on either side of said seam allowance (2). While the embodiment shown in FIGS. 15 and 16, show the first recess (13) and the second recess (27) disposed in the opposed top and bottom surfaces (7)(8) having substantially the same overlaying configuration; the invention is not so limited, and the first recess (13) can have substantially different configuration or placement on the top surface (8) than the second recess (27) disposed in the bottom surface (9). The placement and configuration of the recesses (13)(27), as described, can also be achieved when the cutting guide has a quadrilateral configuration, as detailed above, where the cutting guide is not substantially configured as a square or rectangle.

Figure 17:
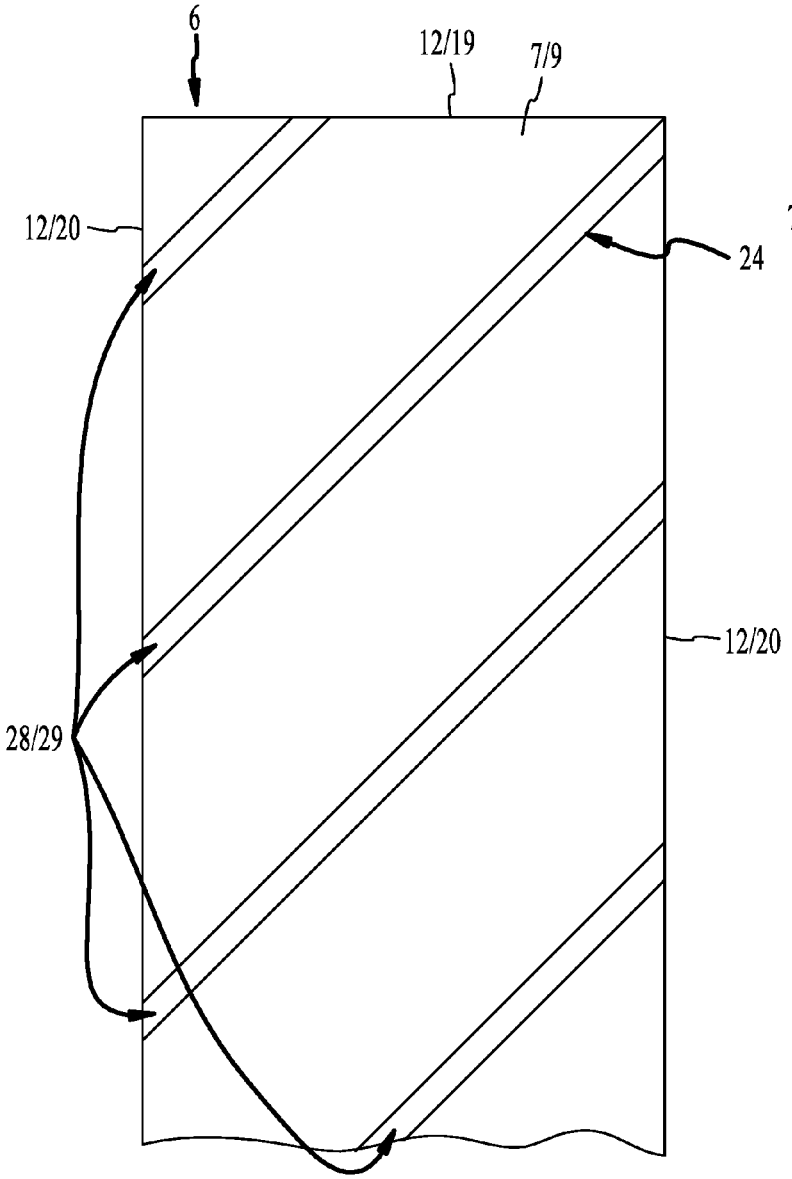
FIG. 17 is a bottom plan view of another particular embodiment of the inventive cutting guide having a plurality of recesses.
Figure 18:
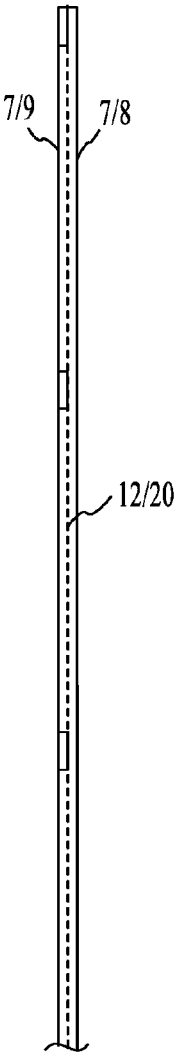
FIG. 18 is a side view of the particular embodiment of the inventive cutting guide having a plurality of recesses as shown in FIG. 17.

Now referring primarily to FIGS. 17 and 18, certain embodiments of the inventive cutting guide (6) can provide a elongate rectangular body (7) having a thickness sufficient to guide a cutting tool (11) (as shown in FIG. 1) along one of a plurality of sides (12) of the body (7). A plurality of recesses (28) having a pair of opposed sides (19)(20) and a cross member (16) can be disposed in the bottom surface (9) (or the top surface (8) or both surfaces) of the body (7). Each of the plurality of recesses (28) can define a corresponding plurality of a passages (29) which communicates between opposed sides (30)(31) of the body (7). Each of the plurality of recesses (28) can have dimensions sufficient to receive a seam allowance (2) of a pair of materials (3) joined at a seam (4) with the corresponding surface (8)(9) engaged with said pair of materials (3) on either side of said seam allowance (2). The placement of the plurality of recesses (13), as described, can also be achieved when the cutting guide has a quadrilateral configuration, as detailed above, where the cutting guide is not substantially configured as a square or rectangle.

As to each of the examples of the inventive cutting guides (6) shown in the Figures, the bottom surface (9) or the top surface (8) or both can further include graphic indicia or numeric indicia (not shown) imprinted or applied to the surface for instruction, placement or measurement.

As can be easily understood from the foregoing, the basic concepts of the present invention may be embodied in a variety of ways. The invention involves numerous and varied embodiments of a cutting guide with a seam allowance recess and methods for making and using such a cutting guide with a seam allowance recess including the best mode.

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of a "quadrilateral configuration" should be understood to encompass disclosure of the act of "configuring a quadrilateral"—whether explicitly discussed or not—and, conversely, were there effectively disclosure of the act of "configuring a quadrilateral", such a disclosure should be understood to encompass disclosure of a "quadrilateral configuration" and even a "means for configuring a quadrilateral." Such alternative terms for each element or step are to be understood to be explicitly included in the description.

In addition, as to each term used it should be understood that unless its utilization in this application is inconsistent with such interpretation, common dictionary definitions should be understood to be included in the description for each term as contained in the Random House Webster's Unabridged Dictionary, second edition, each definition hereby incorporated by reference.

All numeric values herein are assumed to be modified by the term "about", whether or not explicitly indicated. For the purposes of the present invention, ranges may be expressed as from "about" one particular value to "about" another particular value. When such a range is expressed, another embodiment includes from the one particular value to the other particular value. The recitation of numerical ranges by endpoints includes all the numeric values subsumed within that range. A numerical range of one to five includes for example the numeric values 1, 1.5, 2, 2.75, 3, 3.80, 4, 5, and so forth. It will be further understood that the endpoints of each of the ranges are significant both in relation to the other endpoint, and independently of the other endpoint. When a value is expressed as an approximation by use of the antecedent "about," it will be understood that the particular value forms another embodiment. The term "about" generally refers to a range of numeric values that one of skill in the art would consider equivalent to the recited numeric value or having the same function or result. Similarly, the antecedent "substantially" means largely, but not wholly, the same form, manner or degree and the particular element will have a range of configurations as a person of ordinary skill in the art would consider as having the same function or result. When a particular element is expressed as an approximation by use of the antecedent "substantially," it will be understood that the particular element forms another embodiment.

Moreover, for the purposes of the present invention, the term "a" or "an" entity refers to one or more of that entity unless otherwise limited. As such, the terms "a" or "an", "one or more" and "at least one" can be used interchangeably herein.

Thus, Applicant(s) should be understood to claim at least: i) each of the cutting guide with a seam allowance recess herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification, if any, are hereby incorporated by reference as part of this description of the invention, and Applicant expressly reserves the right to use all of or a portion of such incorporated content of such claims as additional description to support any of or all of the claims or any element or component thereof, and Applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

Additionally, the claims set forth in this specification, if any, are further intended to describe the metes and bounds of a limited number of the preferred embodiments of the invention and are not to be construed as the broadest embodiment of the invention or a complete listing of embodiments of the invention that may be claimed. Applicant does not waive any right to develop further claims based upon the description set forth above as a part of any continuation, division, or continuation-in-part, or similar application.

We claim:

1. A cutting guide, comprising:

a body having a top surface and a generally flat bottom surface, each of said top and bottom surfaces extending to each of four sides having unequal lengths, wherein one pair of said four sides joined at a corner defining an interior angle of about 90 degrees, said body having a thickness sufficient to guide a cutting tool along one of a plurality of sides of said body; and a recess disposed in said bottom surface of said body, said recess having a width defined by location of a pair of linear opposed sides disposed a distance apart in generally parallel relation, said recess having a depth defined by location of a cross member coupled between said pair of linear opposed sides, wherein said recess intersects at least a pair of said plurality of sides and said corner defining said interior angle of about 90 degrees.

2. The cutting guide of claim 1, wherein said depth of said recess comprises a height of a seam allowance.

3. The cutting guide of claim 2, wherein said thickness of said body comprises about ⅛ to about ⅝ inches.

4. The cutting guide of claim 3, wherein said width of said recess comprises about ¼ to about ¾ inches.

5. The cutting guide of claim 4, wherein said depth of said recess comprises about 1/16 to about 5/16 inches.

6. The cutting guide of claim 5, wherein one of said pair of linear opposed sides has a location on an axis which intersects said corner defining said interior angle of about 90 degrees and a non-consecutive side of said of said corner defining said interior angle of about 90 degrees.

7. The cutting guide of claim 6, further comprising indicia located on said bottom surface or said top surface and wherein said indicia comprise graphic indicia or numeric indicia.

8. A method of producing a cutting guide, comprising the steps of:

providing a body having a top surface and a generally flat bottom surface, each of said top and bottom surfaces extending to each of four sides having unequal lengths, wherein one pair of said four sides joined at a corner defining an interior angle of about 90 degrees, said body having a thickness sufficient to guide a cutting tool along one of a plurality of sides of said body; and disposing a recess in said bottom surface of said body, said recess having a width defined by location of a pair of linear opposed sides disposed a distance apart in generally parallel relation, said recess having a depth defined by location of a cross member coupled between said pair of linear opposed sides, wherein said recess intersects at least a pair of said plurality of sides and said corner defining said interior angle of about 90 degrees.

9. The method of producing a cutting guide of claim 8, wherein said depth of said recess comprises a height of the seam allowance.

10. The method of producing a cutting guide of claim 9, wherein said thickness of said body comprises about ⅛ to about ⅝ inches.

11. The method of producing a cutting guide of claim 10, wherein said width of said recess comprises about ¼ to about ¾ inches.

12. The method of producing a cutting guide of claim 11, wherein said depth of said recess comprises about 1/16 to about 5/16 inches.

13. The method of producing a cutting guide of claim 12, further comprising locating one of said pair of linear opposed sides on an axis which intersects said corner defining said interior angle of about 90 degrees and a non-consecutive side of said corner defining said interior angle of about 90 degrees.

14. The method of producing a cutting guide of claim 13, further comprising locating indicia on said bottom surface or said top surface and wherein said indicia comprise graphic indicia or numeric indicia.

15. A cutting guide comprising:

a body having a top surface and generally flat bottom surface, each of said top and bottom surfaces extending to each of four sides, wherein two of said four sides have equal length, and wherein a first pair of said four sides join at a corner defining an interior angle of about 90 degrees, and wherein a second pair of said four sides join at a corner defining an interior angle of lesser or greater than 90 degrees, said body having a thickness sufficient to guide a cutting tool along one of a plurality of sides of said body; and a recess disposed in said bottom surface of said body, said recess having a width defined by location of a pair of linear opposed sides disposed a distance apart in generally parallel relation, said recess having a depth defined by location of a cross member coupled between said pair of linear opposed sides, wherein said recess intersects at least a pair of said plurality of sides and said corner defining said interior angle of about 90 degrees.

16. The cutting guide of claim 15, wherein said depth of said recess comprises a height of a seam allowance.

17. The cutting guide of claim 16, wherein said thickness of said body comprises about ⅛ to about ⅝ inches.

18. The cutting guide of claim 17, wherein said width of said recess comprises about ¼ to about ¾ inches.

19. The cutting guide of claim 18, wherein said depth of said recess comprises about 1/16 to about 5/16 inches.

20. The cutting guide of claim 19, wherein one of said pair of linear opposed sides has a location on an axis which intersects said corner defining said interior angle of about 90 degrees and a non-consecutive side of said corner defining said interior angle of about 90 degrees.

21. The cutting guide of claim 20, further comprising indicia located on said bottom surface or said top surface and wherein said indicia comprise graphic indicia or numeric indicia.

22. A method of producing a cutting guide, comprising the steps of:

providing a body having a top surface and generally flat bottom surface, each of said top and bottom surfaces extending to each of four sides, wherein two of said four sides have equal length, and wherein a first pair of said four sides join at a corner defining an interior angle of about 90 degrees, and wherein a second pair of said four sides join at a corner defining an interior angle of lesser or greater than 90 degrees, said body having a thickness sufficient to guide a cutting tool along one of a plurality of sides of said body; and disposing a recess in said bottom surface of said body, said recess having a width defined by location of a pair of linear opposed sides disposed a distance apart in generally parallel relation, said recess having a depth defined by location of a cross member coupled between said pair of linear opposed sides, wherein said recess intersects at least a pair of said plurality of sides and said corner defining said interior angle of about 90 degrees.

23. The method of producing a cutting guide of claim 22, wherein said depth of said recess comprises a height of the seam allowance.

24. The method of producing a cutting guide of claim 23, wherein said thickness of said body comprises about ⅛ to about ⅝ inches.

25. The method of producing a cutting guide of claim 24, wherein said width of said recess comprises about ¼ to about ¾ inches.

26. The method of producing a cutting guide of claim 25, wherein said depth of said recess comprises about 1/16 to about 5/16 inches.

27. The method of producing a cutting guide of claim 26, further comprising locating one of said pair of linear opposed sides on an axis which intersects said corner defining said interior angle of about 90 degrees and a non-consecutive side of said corner defining said interior angle of about 90 degrees.

28. The method of producing a cutting guide of claim 27, further comprising locating indicia on said bottom surface or said top surface and wherein said indicia comprise graphic indicia or numeric indicia.

* * * * *